US008162436B2

(12) United States Patent
Takahashi et al.

(10) Patent No.: US 8,162,436 B2
(45) Date of Patent: Apr. 24, 2012

(54) FLUID DISCHARGING APPARATUS

(75) Inventors: Masaru Takahashi, Matsumoto (JP); Eiichiro Watanabe, Matsumoto (JP); Jun Shimazaki, Shiojiri (JP); Takayuki Kawakami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 966 days.

(21) Appl. No.: 12/165,883

(22) Filed: Jul. 1, 2008

(65) Prior Publication Data

US 2009/0009556 A1 Jan. 8, 2009

(30) Foreign Application Priority Data

Jul. 2, 2007 (JP) ..... 2007-174303

(51) Int. Cl.
*B41J 2/165* (2006.01)

(52) U.S. Cl. ..... 347/33; 347/20; 347/21; 347/22; 347/23; 347/24; 347/25; 347/26; 347/27; 347/28; 347/29; 347/30; 347/31; 347/32; 347/34; 347/35; 347/36; 347/37

(58) Field of Classification Search ..... 347/20–37
See application file for complete search history.

(56) References Cited

U.S. PATENT DOCUMENTS

| | | | | |
|---|---|---|---|---|
| 7,073,886 | B2 * | 7/2006 | Nakamura | 347/33 |
| 7,090,728 | B2 * | 8/2006 | Nakamura | 134/6 |
| 7,481,512 | B2 | 1/2009 | Koizumi | |
| 8,007,861 | B2 | 8/2011 | Koizumi | |
| 2005/0185016 | A1 * | 8/2005 | Mori et al. | 347/33 |
| 2006/0236927 | A1 * | 10/2006 | Nakamura | 118/302 |
| 2008/0284813 | A1 | 11/2008 | Koizumi | |

FOREIGN PATENT DOCUMENTS

| | | |
|---|---|---|
| JP | 2000-006437 | 1/2000 |
| JP | 2004-230640 | 8/2004 |
| JP | 2005-238611 | 9/2005 |
| JP | 2001171135 A * | 10/2005 |
| JP | 2006-159034 | 6/2006 |

* cited by examiner

*Primary Examiner* — Ryan Lepisto
*Assistant Examiner* — Guy Anderson
(74) *Attorney, Agent, or Firm* — Workman Nydegger

(57) ABSTRACT

A fluid discharging apparatus including a head that has a nozzle which discharges fluid from the nozzle and a sheet shaped wiping member for wiping a nozzle surface of the head. The wiping member is moved relative to the nozzle surface so that portions of the wiping member are sequentially in contact with the nozzle surface in order to wipe the nozzle surface.

11 Claims, 3 Drawing Sheets

FLUID DISCHARGING APPARATUS

BACKGROUND OF THE INVENTION

The entire disclosure of Japanese Patent Application No. 2007-174303, filed Jul. 2, 2007 is expressly incorporated herein by reference.

TECHNICAL FIELD

The present invention relates to a fluid discharging apparatus. More particularly, the present invention relates to a fluid discharging apparatus including a recording head which is capable of discharging fluid from a plurality of nozzles and a wiping member for wiping a nozzle surface of the recording head.

RELATED ART

One example of a fluid discharging apparatus currently known in the art is an ink jet printer, which includes a recording head which discharges an ink from a plurality of nozzles. In such ink jet printers, the recording head forms dots on a medium, such as paper, by discharging ink from nozzles onto the medium as the medium is transported through the printer. One example of one such ink jet printer is disclosed in Japanese Patent No. JP-A-2000-6437.

Typically, the ink jet printer has a function for cleaning the recording head. Usually, during this process, ink is first removed from the nozzles of the recording head by a sucking mechanism. Then, the nozzle surface of the recording head is wiped, in order to clear away any excess liquid from the nozzle surface. Generally, a blade formed of rubber is used to wipe the nozzle surface.

However, one problem with blades formed of rubber, is that wiping is not always appropriately performed. For this reason, a new method for appropriately wiping the nozzle surface of a recording head is needed.

BRIEF SUMMARY OF THE INVENTION

An advantage of some aspects of the invention is that it provides a fluid discharging apparatus capable of accurately wiping the nozzle surface of a recording head.

One aspect of the invention is a fluid discharging apparatus including a recording head that has a nozzle which is capable of discharging fluid from the nozzle and a sheet shaped wiping member for wiping a nozzle surface of the recording head, the wiping member capable of being moved with respect to the nozzle surface such that initially a first part of the wiping member is in contact with the nozzle surface while a second part of the wiping member is not in contact with the nozzle surface, wherein the second part of the wiping member sequentially comes in contact with the nozzle surface in order wipe the nozzle surface.

According to the fluid discharging apparatus described above, wiping of the nozzle surface of the recording head is appropriately performed.

Other advantages of the invention will be apparent from this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Configuration of a Printer 1

Figure 1:
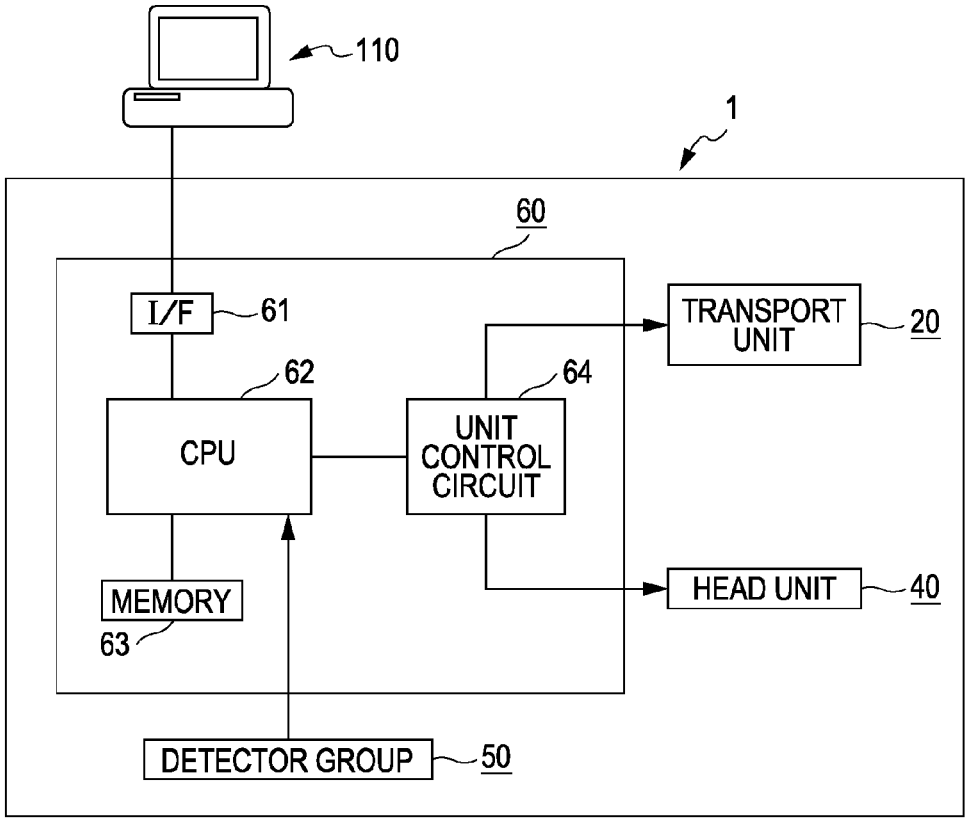
FIG. 1 is a block diagram illustrating a printer.

FIG. 1 is a block diagram illustrating an ink jet printer (hereinafter, referred to as a 'printer 1'), which comprises an example of a fluid discharging apparatus capable of performing aspects of the present invention. In addition, the printer 1 according to the present embodiment is called a line printer that uses a fixed recording head (line recording head) with a length that corresponds to the width of the target paper without being moved by a carriage. Hereinafter, the basic configuration of the printer will be described.

The printer 1 includes a transport unit 20, a recording head unit 40, a detector group 50, and a controller 60. The printer 1 receives print data from a computer 110, which acts as an external apparatus. The printer then controls each of the units (the transport unit 20 and the recording head unit 40) by using the controller 60 based on the print data received from the computer 110 in order to print an image on paper S. The status of the printer 1 is monitored by the detector group 50, and the detector group 50 outputs a detection result to the controller 60. The controller 60 controls each unit based on the detection result output from the detector group 50.

The transport unit 20 serves to transport a medium, such as the paper S, in a predetermined transport direction. The transport unit 20 has a paper feed roller for feeding the paper S set in a paper loading port into the printer, a transport roller for transporting the paper S fed by the paper feed roller to a printable region, a platen 22 (shown in FIG. 3) for supporting the paper S being printed, and a paper discharge roller for discharging the paper S to the outside of the printer.

The recording head unit 40 has a recording head 42 which is provided with a plurality of nozzles 44 and a wiping device 48 for wiping a nozzle surface 46 of the recording head 42.

The recording head 42 forms dots on the paper S facing the recording head 42 by discharging ink, which is an example of fluid capable of being discharged from the printer 1, from the nozzles 44 onto the paper S as it is transported through the printer 1 in order to print an image on the paper S. As described above, the recording head 42 according to the present embodiment is a line recording head is fixed with its longest side extending in a direction that is orthogonal to the transport direction, herein referred to as the paper width direction. Thus, the recording head 42 can form dots along the entire width of paper during a single paper transport operation.

Figure 2:
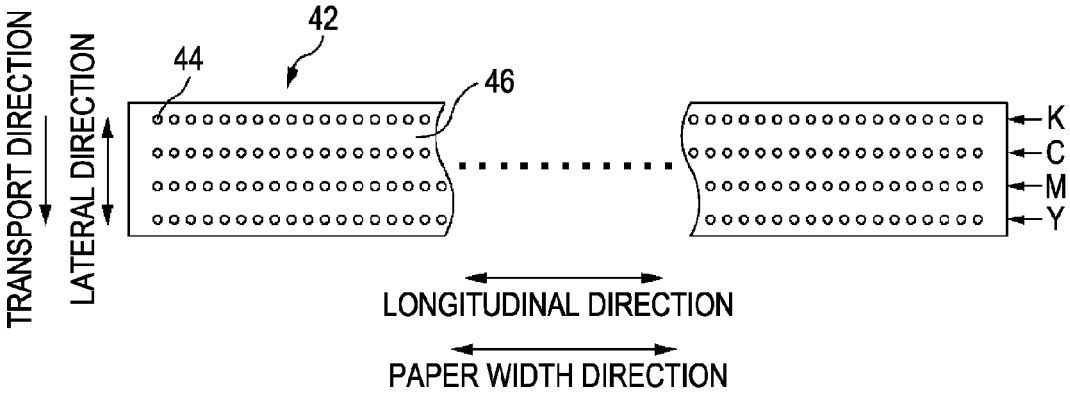
FIG. 2 is an explanatory view illustrating the arrangement of nozzles on a nozzle surface of a recording head.

FIG. 2 is an explanatory view illustrating the arrangement of nozzles 44 on the nozzle surface 46, or bottom surface of the recording head 42. A black ink nozzle row K, a cyan ink nozzle row C, a magenta ink nozzle row M, and a yellow ink nozzle row Y are formed on the nozzle surface 46. Each nozzle row includes a plurality of nozzles 44, and the plurality of nozzles in each nozzle row are located in a line in the paper width direction at fixed nozzle pitches. In addition, the wiping device 48 will be described more fully below.

The detector group 50 includes various kinds of sensors, and a detection sensor described more fully below is also included in the detector group 50.

The controller 60 is a control unit for controlling the printer. The controller 60 includes an interface section 61, a CPU 62, a memory 63, and a unit control circuit 64. The interface section 61 transmits and receives data sent between the printer 1 and the computer 110. The CPU 62 is an operation processing unit for controlling the printer. The memory 63 provides a region for storing and executing programs of the CPU 62, and the like. The memory 63 has memory devices, such as a RAM that is a volatile memory and an EEPROM that is a nonvolatile memory. The CPU 62 controls each unit through the unit control circuit 64 according to the program stored in the memory 63.

Wiping Device 48

As previously described, the ink jet printers currently known in the art perform cleaning processes, wherein ink is first sucked from the recording head through the nozzles by a sucking mechanism, which is followed by a wiping process wherein the nozzle surface of the recording head is wiped. The printer 1 of the present embodiment also performs a cleaning process. In the present embodiment, however, both the ink removal and nozzle wiping process are not performed at the time of cleaning. More specifically, only the nozzle wiping process is performed using the wiping device 48 described more fully below. That is, in the present embodiment, the ink removal process is omitted. Accordingly, the nozzle wiping process of the present embodiment replaces the ink removal and the nozzle wiping processes currently known in the related art.

Next, the configuration and operation of the wiping device 48 according to the present embodiment will be described. The operation of the wiping device 48 is mainly controlled by the controller 60 in the printer 1. Particularly in the present embodiment, the operation is performed when the CPU 62 processes a program stored in the memory 63. In addition, the program is made by executing codes for performing various kinds of operations described below.

Figure 3:
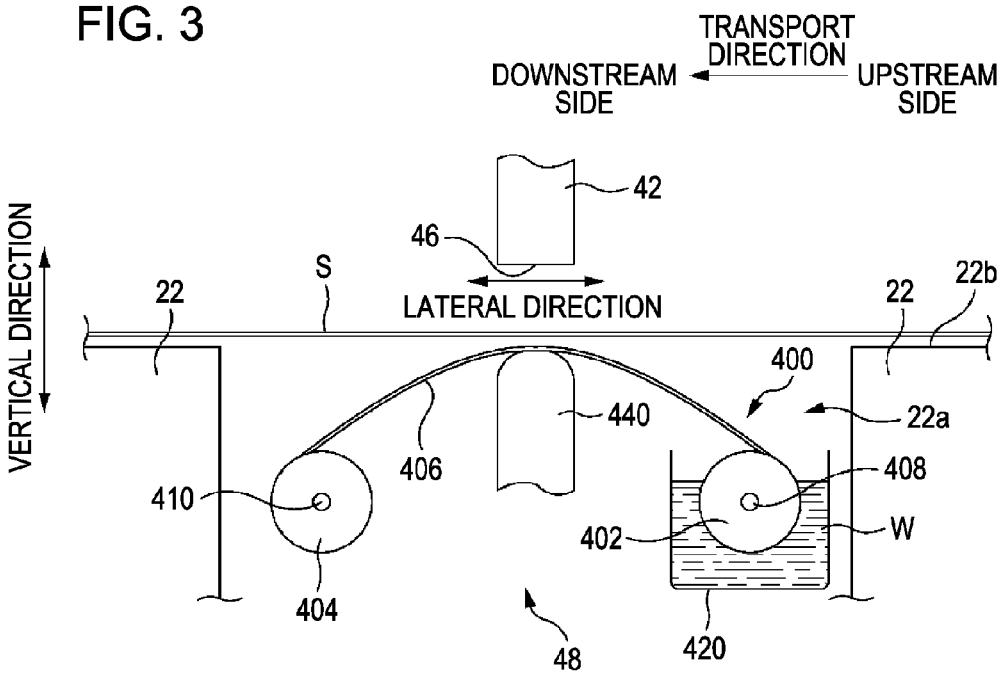
FIG. 3 is a schematic view illustrating states of a wiping device and peripheral members when the wiping device is in a standby state.
Figure 4:
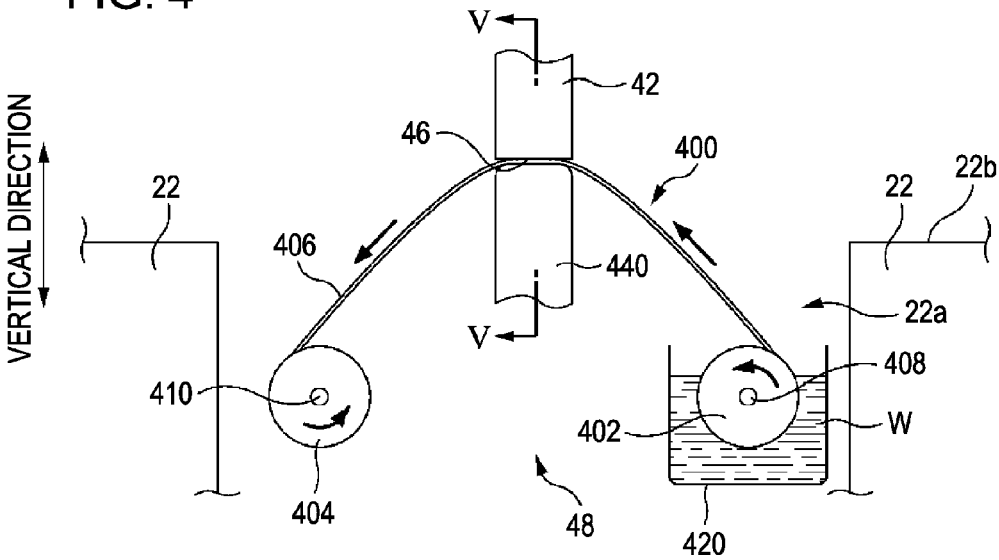
FIG. 4 is a schematic view illustrating states of the wiping device and peripheral members when the wiping device is being operated.
Figure 5:
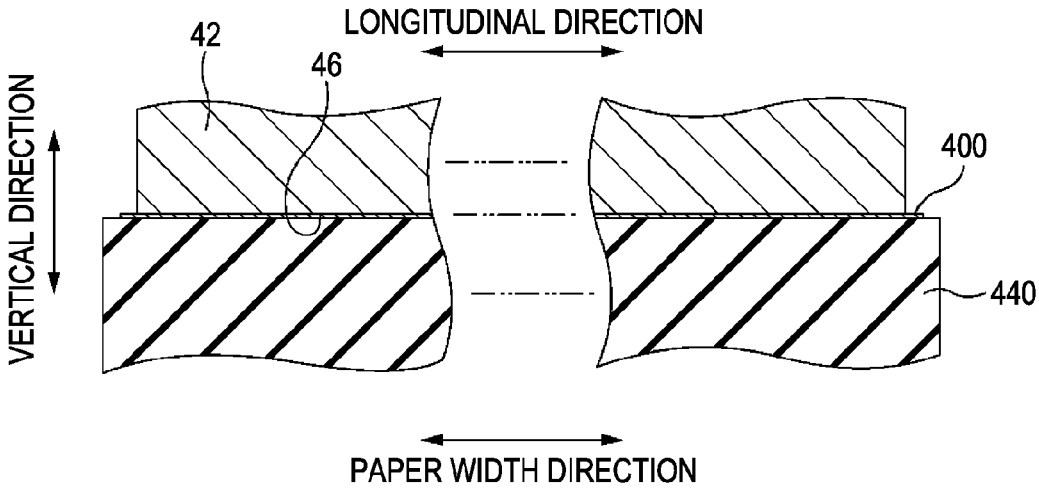
FIG. 5 is a cross-sectional view taken along the line V-V of FIG. 4.

FIGS. 3 to 5 are schematic views illustrating the wiping device 48 and peripheral members in the area around the wiping device 48. FIG. 3 is a schematic view illustrating the state of the wiping device 48 and peripheral members when the wiping device 48 is in a standby state, that is, while the wiping device 48 is not operating. FIG. 4 is a schematic view illustrating the state of the wiping device 48 and peripheral members when the wiping device 48 is in an operation state, that is, when the wiping device 48 is being operated. FIG. 5 is a cross-sectional view taken along the line V-V of FIG. 4 with the paper S is shown in FIG. 3. That is, examples of the standby state of the wiping device 48 include a standby state that is performed during a printing process, wherein the wiping device 48 stands by while the printing process is performed, and a standby state when no printing process is being performed, wherein the wiping device 48 stands by while printing is not being performed. FIG. 3 illustrates the standby state during a printing process.

The wiping device 48 includes a cloth 400, which comprises an example of a sheet shaped wiping member, a wetting portion 420, and a pressure member 440. As shown in FIG. 3 or 4, the wiping device 48 is provided between the platens 22 at a position corresponding to the position of the recording head 42. That is, a groove 22*a* formed along the paper width direction, or longitudinal direction of the nozzle surface 46 of the recording head 42, is provided at a position of the platen 22 which corresponds to the position of the recording head 42, with the wiping device 48 being provided in the groove 22*a*.

The cloth 400 is a sheet shaped wiping member that is brought into contact with the nozzle surface 46 of the recording head 42 in order to wipe the nozzle surface 46. The cloth 400 is a roll cloth. The cloth 400 includes a portion (roll portion) that has a rolled shape and a portion (non-roll portion 406) that does not have a rolled shape. More specifically, the cloth 400 includes two rolled portions. Hereinafter, the rolled portion located upstream from the recording head in the transport direction is referred to as an upstream-side roll portion 402 and the rolled portion located downstream from the recording head in the transport direction is referred to as a downstream-side roll portion 404, as shown in FIG. 3 or 4. Furthermore, a non-rolled portion 406 is located between the upstream-side roll portion 402 and the downstream-side roll portion 404. A middle portion of the non-roll portion 406 faces the nozzle surface 46 of the recording head 42. In addition, as shown in FIG. 3 or 4, the non-roll portion 406 is located at an above the upstream-side roll portion 402 or the downstream-side roll portion 404. The middle portion of the non-roll portion 406 is located furthest above the rolled portions, with the either side of the non-roll portion 406 extending toward the downstream-side roll portion 404 and the upstream-side roll portion 402.

In addition, the location the non-roll portion 406 in the vertical direction is different between the time when the wiping device 48 is in the standby state and the time when the wiping device 48 is in the operation state. That is, as shown in FIG. 3, when the wiping device 48 is in the standby state, the non-roll portion 406 is located below an upper surface 22*b* of the platen 22. In the present embodiment, the middle portion of the non-roll portion 406 is positioned slightly below the upper surface 22*b* when the printer 1 is in the standby state, so that the paper S may be transported during the printing process. On the other hand, as shown in FIG. 4, when the wiping device 48 is in the operation state, the middle portion of the non-roll portion 406 is positioned at a higher elevation so that the middle portion may come in contact with the nozzle surface 46 in order to wipe the nozzle surface 46. As shown in FIG. 5, the length of the cloth 400 in the paper width direction is larger than the length of the nozzle surface 46 of the recording head 42 in the longitudinal direction.

Accordingly, the middle portion comes in contact with the nozzle surface 46 from one end of the nozzle surface 46 to the other end in the longitudinal direction. In addition, as described more fully below, the position of the non-roll portion 406 in the vertical direction between the standby state and the operation state is controlled by moving the pressure member 440 in the vertical direction.

Furthermore, during the operation state, the non-roll portion 406 moves in the direction indicated by the arrow shown in FIG. 4, that is, from the upstream side to the downstream side in the transport direction while being in contact with the nozzle surface 46. That is, one part of the cloth 400 is in contact with the nozzle surface 46 from one end of the nozzle surface 46 to the other end by moving the cloth 400 relative to the nozzle surface 46. Accordingly, the other parts of the cloth 400, which are positioned on the upstream side of the transport direction in which are not initially in contact with the nozzle surface 46, subsequently come into contact with the nozzle surface 46. That is, the other portions of the cloth 400 are sequentially moved to the middle portion, where they eventually come into contact with the nozzle surface 46 in order to wipe the nozzle surface 46.

The movement of the cloth 400 is caused by a motor (not shown). That is, an upstream-side rotary shaft 408 and a downstream-side rotary shaft 410 are provided at places near the centers of the upstream-side roll portion 402 and the downstream-side roll portion 404, respectively, and the upstream-side roll portion 402 is supported by the upstream-side rotary shaft 408 and the downstream-side roll portion 404 is supported by the downstream-side rotary shaft 410. In addition, the torque of a motor (not shown) is not transmitted to the downstream-side rotary shaft 410. When the torque is transmitted, the downstream-side rotary shaft 410 rotates to roll the cloth 400. More specifically, when the torque of the motor is transmitted to the downstream-side rotary shaft 410, the downstream-side rotary shaft 410 rotates in the direction indicated by the arrow shown in FIG. 4, which is the counterclockwise direction, so that the non-roll portion 406 is rolled toward the side of the downstream-side roll portion 404. Accordingly, the non-roll portion 406 of the cloth 400 moves in the direction indicated by the arrow of FIG. 4, that is, from the upstream side to the downstream side in the transport direction. In this embodiment, the upstream-side rotary shaft 408 functions as a driven shaft which rotates in the counterclockwise direction, as indicated by the arrow of FIG. 4.

Here, as the non-roll portion 406 moves from the upstream side to the downstream side in order to wipe the nozzle surface 46, a portion located in the non-roll portion 406 of the cloth 400 is rolled by rotation of the downstream-side rotary shaft 410 in order to be located in the downstream-side roll portion 404. At the same time, a portion located in the upstream-side roll portion 402 of the cloth 400 is pulled to be in the non-roll portion 406. Accordingly, after wiping of the nozzle surface 46 is executed several times, the cloth is moved to the downstream-side roll portion 404.

In view of the above situation, rewinding of cloth 400 can be performed in the present embodiment. That is, the printer 1 according to the present embodiment is provided with a detection sensor (not shown), which may comprise, for example, a detection sensor that detects the thickness of the upstream-side roll portion 402 in the radial direction, in order to detect that the cloth in the upstream-side roll portion 402 is running low. The printer 1 according to the present embodiment is configured such that the detection sensor operates immediately after wiping of the nozzle surface 46 is completed when the state of the wiping device 48 changes to a standby state. In addition, when the detection sensor detects that the cloth in the upstream-side roll portion 402 is low, a rewinding process is performed, wherein the cloth 400 is moved from the downstream side to the upstream side.

In order to realize those described above, in the present embodiment, the torque of a motor is transmitted to not only the downstream-side rotary shaft 410 but also the upstream-side rotary shaft 408. When the torque is transmitted, the downstream-side rotary shaft 410 rotates to unroll the cloth 400 therearound. When the torque of the motor is transmitted to the upstream-side rotary shaft 408, the upstream-side rotary shaft 408 rotates (that is, rotates in the clockwise direction that is opposite to the direction indicated by the arrow shown in FIG. 4, so that the non-roll portion 406 is rolled toward the upstream-side roll portion 402. Accordingly, the non-roll portion 406 of the cloth 400 moves in the direction opposite the direction indicated by the arrow of FIG. 4, that is, from the downstream side to the upstream side. In addition, in this embodiment, the downstream-side rotary shaft 410 functions as a driven shaft which rotates in the clockwise direction, which is opposite to the direction indicated by the arrow of FIG. 4.

In addition, transmission of the torque of the motor to the upstream-side rotary shaft 408 and the downstream-side rotary shaft 410 is realized by a known transmission mechanism configured to include a gear, a cam, and the like.

The wetting portion 420 serves to make the cloth 400 wet with wetting liquid W. The wetting portion 420 is a container that contains the wetting liquid W therein and is long in the paper width direction that is orthogonal to the transport direction. The upstream-side roll portion 402 is accommodated in the wetting portion 420, such that the upstream-side roll portion 402 is always submerged in the wetting liquid W. In addition, when wiping the nozzle surface 46, a wet portion of the cloth 400 in the upstream-side roll portion 402 is pulled to be positioned in the non-roll portion 406, where the wetted portion comes in contact with the nozzle surface 46. That is, the nozzle surface 46 is wiped by the wet cloth 400. Furthermore, although purified water is used as the wetting liquid W in the present embodiment, the wetting liquid W is not limited thereto. For example, tap water or other liquid other than the water may also be used.

The pressure member 440 moves when wiping using the cloth 400 to presses the cloth 400 to bring a part of the cloth 400 into contact with the nozzle surface 46 from one end of the nozzle surface 46 to the other end. The pressure member 440 is an elastic body which is long in the paper width direction, which is perpendicular to the transport direction, as shown in FIG. 5. The pressure member 440 may be formed of rubber. As shown in FIG. 3 or 4, the pressure member 440 is located between the upstream-side roll portion 402 and the downstream-side roll portion 404 and is provided at a position corresponding to the nozzle surface 46.

In addition, the pressure member 440 moves in the vertical direction when the wiping device 48 changes from the standby state to the operation state when the wiping process is started and again when the state changes from the operation state to the standby state when the wiping process is completed.

That is, as shown in FIG. 3, when the wiping device 48 is in the standby state, the pressure member 440 is located below the upper surface 22*b* of the platen 22. This allows the paper S to be transmitted beneath the nozzle surface 46 during a printing operation. The pressure member 440 moves upward when the state of the wiping device 48 changes from the standby state to the operation state. As a result, as shown in FIG. 4, the non-roll portion 406 of the cloth 400 is pressed by the pressure member 440 and thus a part of the cloth 400 is brought into contact with the nozzle surface 46. Then, the non-roll portion 406 is moved relative to the nozzle surface 46 when a part of the cloth 400 is in contact with the nozzle surface 46. As a result, the other part of the cloth 400 that is not in contact with the nozzle surface 46 sequentially comes in contact with the nozzle surface 46 in order to wipe the nozzle surface 46. During this time when the cloth 400 is in contact with the nozzle surface, the pressure member 440 does not move and accordingly, serves to maintain contact of the non-roll portion 406 to the nozzle surface 46.

On the other hand, when the wiping process is completed and the state of the wiping device 48 changes from the operation state to the standby state, the pressure member 440 moves downward. Then, the non-roll portion 406 of the cloth 400 falls due to gravity to create a space between the cloth 400 and the nozzle surface 46. In addition, when the pressure member 440 moves downward, the torque of the motor is transmitted to the downstream-side rotary shaft 410 and the non-roll portion 406 is rolled toward the side of the downstream-side roll portion 404 by rotation of the downstream-side rotary shaft 410. As a result, in the standby state, the cloth 400 is in the state shown in FIG. 3 instead of a loose state.

In addition, as shown in FIG. 5, the length of the pressure member 440 in the paper width direction is larger than the length of the nozzle surface 46 of the recording head 42. Therefore, the pressure member 440 makes the cloth 400 contact the nozzle surface 46 from one end of the nozzle surface 46 to the other end. In addition, the pressure member 440 moves when the torque of the motor is transmitted to the pressure member 440 using a transmission mechanism configured to include a gear, a cam, or the like.

Effectiveness of the Printer 1

The printer 1 according to the present embodiment includes a recording head 42 that has a nozzle 44 which is capable of discharging ink from the nozzle 44 and a cloth 400 comprising a sheet shaped wiping member which is capable of wiping the nozzle surface 46 of the recording head 42. The cloth 400 is moved relative to the nozzle surface 46, such that a first part of the cloth 400 is initially in contact with the nozzle surface 46 while a second part of the cloth 400 is not in contact with the nozzle surface 46. Subsequently, the second part of the cloth 400 comes in contact with the nozzle surface 46 to thereby wipe the nozzle surface 46. In this manner, wiping of the nozzle surface 46 of the recording head 42 is performed.

As already described, conventional systems wipe the nozzles using a blade formed of rubber, wherein the blade is moved with respect to the nozzle surface. One problem with this configuration, however, is that the blade passes along the nozzle surface very quickly, meaning that there may be portions of the nozzle surface that are not adequately wiped.

In contrast, in the present embodiment, the cloth 400 serves as a wiping member. The cloth is moved with respect to the nozzle surface 46 in order to wipe the nozzle surface 46 as previously described. Because different portions of the cloth 400 come in contact with the nozzle surface 46, each part of the nozzle surface 46 is sequentially and continuously cleaned.

In addition, in the configurations currently used, the wiping member is configured to make a large portion of the wiping member come in contact with the surface of the nozzle surface 46, the wiping member needs to be relatively large. Particularly in the case where a line recording head having a long shape is used as the recording head 42, the increase in the size of the wiping member becomes noticeable. In the present embodiment, however, the wiping member is formed as a sheet shaped member, such as the cloth 400, which is a member with little thickness. Accordingly, the wiping member can be appropriately provided in the printer 1. In contrast, if the wiping member is too thick, the wiping member cannot be appropriately provided in the printer 1, and the wiping process cannot be performed.

That is, in the present embodiment, the wiping member is formed as the sheet shaped member instead of the blade type wiping member currently used in the art in order to obtain a wiping method in which the wiping member is capable of being moved relative to the nozzle surface 46 such that parts of the wiping member are sequentially in contact with the nozzle surface 46 in order wipe the nozzle surface 46. In addition, wiping of the nozzle surface 46 of the recording head 42 is appropriately performed by using the wiping method realized by forming the wiping member as the sheet shaped member.

Other Embodiments

The fluid discharging apparatus is described using a single embodiment of the invention for ease of understanding, but is not limited to the embodiments described above. Thus, various modifications and changes may be made without departing from the spirit and scope of the invention, and the equivalents are included in the invention.

For instance, in the above embodiment, the fluid discharging apparatus is described as an ink jet printer. However, any fluid discharging apparatus that ejects or discharges fluid, such as a liquid, a liquid-like body in which particles of a functional material are dispersed, a fluid-like body, such as gel, or a solid material that can flow as fluid and be discharged, other than ink may also be used. For example, liquid discharging apparatuses for manufacturing liquid crystal displays, EL (electroluminescent displays, and surface-emitting displays that discharge a liquid-like body containing a material, such as an electrode material or a color material, in the form of dispersion or solution may perform aspects of the invention. In addition, liquid discharging apparatuses that discharge biological organic matter in order to manufacture biochips and liquid discharging apparatuses acting as precision pipettes that discharge samples of a liquid may also perform aspects of the invention. In addition, liquid discharging apparatuses that discharge pinpoints of lubricating oil to precision instruments, such as a watch and a camera, liquid discharging apparatuses that discharge transparent resin liquid, such as ultraviolet curing resin, onto a substrate in order to form minute hemispherical lenses (optical lens) for optical communication devices or the like, may also perform aspects of the invention. Moreover, liquid discharging apparatuses that discharge acid etching liquid or alkali etching liquid in order to etch a substrate or the like, fluid discharging apparatuses that discharge gel, and a powder discharge types of recording apparatuses that discharge solid materials, such as toner may also perform aspects of the invention. Thus, the invention may be applied to any number of discharging apparatuses.

Furthermore, in the above embodiment, the line recording head is used an example of a recording head, however, the invention is not so limited. For example, a serial recording head may be used, wherein a the recording head is provided in a carriage which moves in the paper width direction to perform a printing operation.

Furthermore, in the above embodiment, a cloth 400 is used as an example of the sheet shaped wiping member, but the invention is not limited to this example. For example, paper may also be used.

In addition, in the above embodiment, a wiping member is the wet cloth 400 and includes the wetting portion 420 for making the cloth 400 wet with wetting liquid W. That is, the nozzle surface 46 is wiped by a cloth 400 wetted by the wetting portion 420, however, the invention is not so limited. For example, the printer 1 may not include the wetting portion, and the nozzle surface 46 may be wiped by a dry cloth.

However, the method in the embodiment described above is more preferable from the point of view that the nozzle surface 46 may be wiped without damaging the nozzle surface 46. In addition, the wetting liquid W having permeated into the cloth 400 can function to remove any clogs in the nozzle. Accordingly, the sucking mechanism described above is not needed, making the above embodiment more desirable.

Furthermore, in the embodiment described above, the cloth 400 is moved relative nozzle surface 46 along the lateral direction of the nozzle surface 46 such that portions of the cloth 400 sequentially come into contact with the nozzle surface 46 in order to wipe the nozzle surface 46. In other configurations, however, the cloth 400 may also be moved along the longitudinal direction of the nozzle surface 46. However, the wiping device 48 described in the first embodiment may be smaller than in this configuration, making the first embodiment more preferable.

The printer 1 of the embodiment described above includes the pressure member that presses the cloth 400 to make a part of the cloth 400 come in contact with the nozzle surface 46, but the invention is not so limited. For example, the printer may not include the pressure member, but a mechanism for moving the cloth in the vertical direction may be provided instead of the pressure member so that the mechanism moves the cloth upward to make a part of the cloth come in contact with the nozzle surface.

In the above embodiment, the pressure member 440 causes a part of the cloth 400 come in contact with the nozzle surface 46 from one end of the nozzle surface 46 in the longitudinal direction to the other end, but the invention is not so limited. For example, a pressure member (pressure roller 460) described below may also be used.

Figure 6:
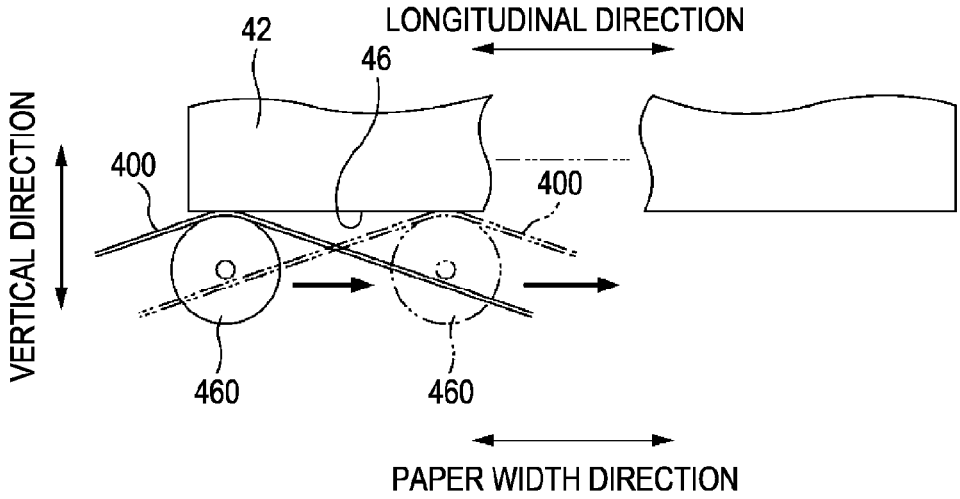
FIG. 6 is an explanatory view illustrating a pressure roller.

FIG. 6 is a view corresponding to FIG. 5 and is an explanatory view illustrating the pressure roller 460. The pressure roller 460 is a roller having a surface formed of an elastic material, such as rubber. Similar to the pressure member 440, the pressure roller 460 is located between the upstream-side roll portion 402 and the downstream-side roll portion 404 and is provided at the position that corresponds to the nozzle surface 46. In addition, the pressure roller 460 moves in the vertical direction when the state of the wiping device 48 changes between the standby state to the operation state, which is also similar to the pressure member 440.

That is, when the wiping device 48 is in the standby state, the pressure roller 460 is located below the upper surface 22*b* of the platen 22. The pressure roller 460 moves upward when the state of the wiping device 48 changes from the standby state to the operation state. As a result, as indicated by a solid line of FIG. 6, the non-roll portion 406 of the cloth 400 is pressed by the pressure roller 460 and thus a part of the cloth 400 is brought into contact with the nozzle surface 46.

In addition, the non-roll portion 406 is moved with respect to the nozzle surface 46 along the lateral direction of the nozzle surface 46 such that portions of the cloth 400 sequentially contact the nozzle surface 46 in order to wipe the nozzle surface 46. In this case, however, unlike the pressure member 440, the pressure roller 460 moves in the longitudinal direction of the nozzle surface 46 in order to change the contact position of the cloth 400 to the nozzle surface 46, as shown in FIG. 6. In addition, the moving speed of the pressure roller 460 is lower than that of the cloth 400 in the present embodiment so that the wiping may be appropriately performed.

When the wiping process is completed and the state of the wiping device 48 changes from the operation state to the standby state, the pressure roller 460 moves downward. Then, the non-roll portion 406 of the cloth 400 falls due to gravity to make the cloth 400 spaced apart from the nozzle surface 46. In addition, the pressure roller 460 moves in the vertical direction or along the longitudinal direction, the torque of the motor is transmitted to the pressure roller 460 using a transmission mechanism configured to include a gear, a cam, and the like.

Thus, either the pressure member 440 or the pressure roller 460 may be used as a pressure member that makes the cloth 400 come in contact with the nozzle surface 46. The former case is preferable from the point of view that a mechanism for moving a pressure member is simpler since a mechanism for moving the pressure member along the longitudinal direction of the nozzle surface 46 is not required. On the other hand, the latter case is preferable from the point of view that a pressure member can be made small since the pressure member does not need to be formed in the shape which is longer in the paper width direction.

Furthermore, in the printer 1 according to the embodiment described above, the sucking mechanism for removing the ink from the nozzles of a recording head is omitted, but the invention is not so limited, and the sucking mechanism may also be provided in the printer.

What is claimed is:

1. A fluid discharging apparatus comprising:

a head that has a nozzle, the head being capable of discharging fluid from the nozzle; and a sheet shaped wiping member for wiping a nozzle surface of the head, the wiping member being moved relative to the nozzle surface, such that initially a first portion of the wiping member is in contact with the nozzle surface while a second portion of the wiping member is not in contact with the nozzle surface, and subsequently, the second portion of the wiping member comes in contact with the nozzle surface in order to wipe the nozzle surface, wherein the first and second portions are movable relative to the nozzle surface such that when not contacting the nozzle surface, the first and second portions are located below an upper surface of a platen of the fluid discharge apparatus and such that the first portion is moved so as to be at a higher elevation than the second portion when contacting the nozzle surface.

2. The fluid discharging apparatus according to claim 1, wherein the wiping member is a wet cloth and the fluid discharging apparatus further comprises a wetting portion capable of wetting the cloth with a wetting liquid.

3. The fluid discharging apparatus according to claim 1, wherein the wiping member is moved relative to the nozzle surface along the lateral direction of the nozzle surface.

4. The fluid discharging apparatus according to claim 3, further comprising a pressure member that is capable of being moved during a wiping process so that the portions of the wiping member are brought into contact with the nozzle surface.

5. The fluid discharging apparatus according to claim 3, further comprising a pressure roller that is capable of pressing the portions of the wiping member such that the portions of the wiping member are brought into contact with the nozzle surface during a wiping process, wherein the pressure roller is moved along the longitudinal direction of the nozzle surface in order to change which portion of the wiping member is in contact with the nozzle surface.

6. A fluid discharging apparatus comprising:

a head that has a nozzle formed in a nozzle surface, the head being capable of discharging fluid from the nozzle; and a sheet shaped wiping member which is capable of wiping the nozzle surface by being moved relative to the nozzle surface, such that portions of the wiping member are sequentially brought into contact with the nozzle surface by being pressed against the nozzle surface, wherein first and second portions of the sheet shaped wiping member are movable relative to the nozzle surface such that when not contacting the nozzle surface, the first and second portions are located below an upper surface of a platen of the fluid discharge apparatus and such that the first portion is moved so as to be at a higher elevation than the second portion when contacting the nozzle surface.

7. The fluid discharging apparatus according to claim 6, wherein the wiping member is a wet cloth and the fluid discharging apparatus further comprises a wetting portion capable of wetting the cloth with a wetting liquid.

8. The fluid discharging apparatus according to claim 6, wherein the wiping member is moved relative to the nozzle surface along the lateral direction of the nozzle surface such that portions of the wiping member are brought into contact with the nozzle surface along the lateral direction.

9. The fluid discharging apparatus according to claim 6, further comprising a pressure member that is capable of being moved during a wiping process in order to cause the portions of the wiping member to be brought into contact with the nozzle surface.

10. The fluid discharging apparatus according to claim 8, further comprising a pressure roller that is capable of pressing the portions of the wiping member such that the portions of the wiping member are brought into contact with the nozzle surface, wherein the pressure roller is moved along the longitudinal direction of the nozzle surface in order to change which portion of the wiping member is in contact with the nozzle surface.

11. A fluid discharging apparatus comprising:

a head that has a nozzle, the head being capable of discharging fluid from the nozzle;

a sheet shaped wiping member for wiping a nozzle surface of the head, the wiping member being moved relative to the nozzle surface, such that initially a first portion of the wiping member is in contact with the nozzle surface while a second portion of the wiping member is not in contact with the nozzle surface, and subsequently, the second portion of the wiping member comes in contact with the nozzle surface in order to wipe the nozzle surface; and a wetting portion capable of wetting the sheet shaped wiping member with a wetting liquid, where at least a portion of the second portion is within the wetting portion prior to contacting the nozzle surface.

* * * * *